US010544572B2

(12) United States Patent
Humber et al.

(10) Patent No.: US 10,544,572 B2
(45) Date of Patent: Jan. 28, 2020

(54) OVERFLOW CAP AND ASSEMBLY

(71) Applicant: IPS Corporation, Collierville, TN (US)

(72) Inventors: Jeffrey A. Humber, Memphis, TN (US); James H. Whitehead, Collierville, TN (US)

(73) Assignee: IPS Corporation, Collierville, TN (US)

( * ) Notice: Subject to any disclaimer, the term of this patent is extended or adjusted under 35 U.S.C. 154(b) by 0 days.

(21) Appl. No.: 15/179,355

(22) Filed: Jun. 10, 2016

(65) Prior Publication Data

US 2017/0356174 A1 Dec. 14, 2017

(51) Int. Cl.
*E03C 1/244* (2006.01)

(52) U.S. Cl.
CPC ..... *E03C 1/244* (2013.01)

(58) Field of Classification Search
CPC . B65D 59/06; E03C 1/232; E03C 1/24; E03C 1/244; E03C 2001/2413; F16L 57/005
USPC ..... 138/89, 90, 96 R, 96 T; 4/694
See application file for complete search history.

(56) References Cited

U.S. PATENT DOCUMENTS 1,548,313 A * 8/1925 Hemmer ..... F23D 5/00 431/214
1,853,946 A * 4/1932 Unke ..... B65D 59/06 138/96 T
3,495,280 A 2/1970 Galbiati
4,720,877 A 1/1988 Watts
5,179,740 A 1/1993 Marsilio et al.
6,073,278 A * 6/2000 Ball ..... E03C 1/24 4/694
6,618,875 B1 * 9/2003 Oropallo ..... E03C 1/24 4/694
6,681,420 B1 1/2004 Ball
(Continued)

FOREIGN PATENT DOCUMENTS

CA 1 246 302 12/1988
CA 1 253 654 5/1989
(Continued)

OTHER PUBLICATIONS

WatcoFlex® (Specifications) WATCO Manufacturing Company (Mar. 2009) 2 pages.

*Primary Examiner* — Erin Deery
*Assistant Examiner* — Nicholas A Ros
(74) *Attorney, Agent, or Firm* — Womble Bond Dickinson (US) LLP

(57) ABSTRACT

An overflow assembly including an overflow cap and a locking ring is described that allows liquid (e.g., water) being received or collected in a plumbing fixture (e.g., a bathtub) to flow into an overflow pipe in an effective, aesthetically pleasing manner using components that are easier to install than some conventional solutions. The locking ring has a threaded inner surface that is designed to be threaded onto an externally threaded end of the overflow pipe that is extended through a wall of the plumbing fixture to secure the overflow pipe with respect to the wall. The overflow cap may then be pressed onto the externally threaded end of the overflow pipe, such that it engages the externally threaded end via engagement tabs. The overflow cap can be removed from the end of the overflow pipe by rotating the cap to unthread it from the threaded end of the overflow pipe.

13 Claims, 7 Drawing Sheets

(56) References Cited

U.S. PATENT DOCUMENTS

| | | | | |
|---|---|---|---|---|
| 7,237,280 | B1 * | 7/2007 | Holden, Jr. | E03C 1/24 4/680 |
| 8,336,132 | B2 * | 12/2012 | Ball | E03C 1/2304 4/683 |
| 8,505,132 | B2 * | 8/2013 | Ball | E03C 1/24 4/680 |
| 8,621,683 | B2 | 1/2014 | Coronado et al. | |
| 8,671,473 | B1 | 3/2014 | Morrone | |
| 2004/0034926 | A1 | 2/2004 | Ball | |
| 2006/0085907 | A1 | 4/2006 | Ball | |
| 2008/0196161 | A1 | 8/2008 | Ball | |
| 2009/0249542 | A1 * | 10/2009 | Uhl | E03C 1/24 4/694 |
| 2014/0223659 | A1 * | 8/2014 | Gay | E03C 1/244 4/694 |

FOREIGN PATENT DOCUMENTS

| | | | | | |
|---|---|---|---|---|---|
| CN | 2012 41358 | Y | | 5/2009 | |
| DE | 2 054 145 | | | 11/1970 | |
| EP | 0325898 | | * | 8/1989 | B65D 59/02 |
| EP | 0 691 438 | A2 | | 1/1996 | |
| EP | 1 826 323 | A2 | | 8/2007 | |
| FR | 2 558 187 | A1 | | 7/1985 | |
| FR | 2 739 115 | A1 | | 3/1997 | |
| FR | 2 799 777 | A1 | | 4/2001 | |
| GB | 1 216 208 | | | 12/1970 | |
| IT | EP0325898 | | * | 8/1989 | B65D 59/02 |
| JP | 2006-063515 | A | | 3/2006 | |
| JP | 2012-241488 | A | | 12/2012 | |
| NZ | 241770 | A | | 7/1995 | |

* cited by examiner

OVERFLOW CAP AND ASSEMBLY

FIELD OF THE INVENTION

The present invention relates generally to overflow assemblies, such as assemblies that are coupled to overflow pipes for preventing overflow of plumbing fixtures such as bathtubs and sinks.

BACKGROUND

Modern residential, commercial, and industrial buildings often have plumbing fixtures that are intended to receive and/or hold water for washing or bathing various objects, people, and/or animals. Such fixtures include bathtubs, sinks, basins, and others. In some cases, such a fixture may be intended to hold a certain amount of water for a length of time to allow a user to immerse an object in the water. In other cases, the fixture serves as an area for receiving the water as it passes from a faucet or other water dispensing fixture to a drain, so as to prevent the water and/or the waste water that is produced as the user makes use of the water from reaching the surroundings.

In some cases, pipes that are connected to the drain of the fixture may be fully or partially plugged, either intentionally (such as through the use of a stopper when the user wishes to take a bath) or accidentally (such as due to a plumbing blockage). In such cases, the water being dispensed may be flowing at a rate that is faster than the rate at which the water is draining through the primary drain. This scenario may cause the fixture (e.g., the bathtub, sink, etc.) to overflow.

BRIEF SUMMARY OF EXAMPLE EMBODIMENTS

Thus, there is a need for improved devices and assemblies for preventing overflow in an easy-to-install, effective, cost-efficient, and aesthetically pleasing manner.

Accordingly, embodiments of the present invention provide an overflow assembly configured to engage an overflow pipe, where the overflow assembly includes an overflow cap and a locking ring. The overflow cap includes a main portion defining an outer surface and an inner surface, where the outer surface is configured to be visible to a user in an installed position in which the overflow cap is engaged with an overflow pipe. The overflow cap further includes a peripheral extension extending transversely from a periphery of the main portion and configured to extend towards a wall through which the overflow pipe is engaged, and at least one engagement tab extending from the inner surface of the main portion and away from the inner and outer surfaces, where the at least one engagement tab is spaced inwardly from the peripheral extension. The peripheral extension defines at least one opening configured to be in fluid communication with the overflow pipe for receiving overflow liquid therethrough. The locking ring comprises a threaded inner surface configured to be threaded onto an externally threaded end of the overflow pipe, and the locking ring is configured to secure the overflow pipe with respect to the wall. The overflow cap is configured to be pressed onto the externally threaded end of the overflow pipe following engagement of the locking ring with the overflow pipe, and the overflow cap is further configured to engage the externally threaded end of the overflow pipe via the at least one engagement tab.

In some cases, the at least one engagement tab of the overflow cap may define an outward-facing surface facing the peripheral extension and an inward-facing surface facing away from the peripheral extension, where the inward-facing surface defines a plurality of teeth configured to slidingly engage the externally threaded end of the overflow pipe. Moreover, the overflow cap may be configured to be disengaged from the externally threaded end of the overflow pipe via rotation of the overflow cap with respect to the overflow pipe. The at least one engagement tab, in some embodiments, may comprise a plurality of engagement tabs. In some embodiments, the peripheral extension may define at least two openings configured to be in fluid communication with the overflow pipe for receiving overflow liquid therethrough.

Additionally or alternatively, the overflow cap may further comprise at least one spacer extending from the inner surface of the main portion and away from the inner and outer surfaces, where the spacer is configured to abut an edge of the externally threaded end of the overflow pipe in the installed position so as to maintain a space between the inner surface of the main portion and the edge of the externally threaded end of the overflow pipe. In some cases, the main portion of the overflow cap may further define at least one slot extending between the inner and outer surfaces of the main portion, wherein the at least one slot is in fluid communication with the overflow pipe. Moreover, the locking ring may comprise an outer surface defining a plurality of grooves configured to provide a gripping surface to the user for installing the locking ring onto the overflow pipe.

In other embodiments, an overflow cap is provided that configured to engage an overflow pipe. The overflow cap comprises a main portion defining an outer surface and an inner surface, wherein the outer surface is configured to be visible to a user in an installed position in which the overflow cap is engaged with an overflow pipe; a peripheral extension extending transversely from a periphery of the main portion and configured to extend towards a wall through which the overflow pipe is engaged, wherein the peripheral extension defines at least one opening configured to be in fluid communication with the overflow pipe for receiving overflow liquid therethrough; and at least one engagement tab extending from the inner surface of the main portion and away from the inner and outer surfaces, wherein the at least one engagement tab is spaced inwardly from the peripheral extension. The overflow cap is configured to be pressed onto a threaded end of the overflow pipe and is configured to engage the threaded end of the overflow pipe via the at least one engagement tab.

In some cases, the at least one engagement tab may define an outward-facing surface facing the peripheral extension and an inward-facing surface facing away from the peripheral extension, wherein the inward-facing surface defines a plurality of teeth configured to slidingly engage the threaded end of the overflow pipe. The overflow cap may be configured to be disengaged from the threaded end of the overflow pipe via rotation of the overflow cap with respect to the overflow pipe. In some cases, the at least one engagement tab may comprise a plurality of engagement tabs.

The peripheral extension may, in some embodiments, define at least two openings configured to be in fluid communication with the overflow pipe for receiving overflow liquid therethrough. Additionally or alternatively, the overflow cap may further comprise at least one spacer extending from the inner surface of the main portion and away from the inner and outer surfaces, wherein the spacer is configured to abut an edge of the threaded end of the overflow pipe in the installed position so as to maintain a space between the inner surface of the main portion and the edge of the threaded end of the overflow pipe. The main portion may, in some cases, further define at least one slot extending between the inner and outer surfaces of the main portion in fluid communication with the overflow pipe.

In still other embodiments, a method of manufacturing an overflow cap is provided that comprises forming a main portion defining an outer surface and an inner surface, wherein the outer surface is configured to be visible to a user in an installed position in which the overflow cap is engaged with an overflow pipe; providing a peripheral extension extending transversely from a periphery of the main portion and configured to extend towards a wall through which the overflow pipe is engaged, wherein the peripheral extension defines at least one opening configured to be in fluid communication with the overflow pipe for receiving overflow liquid therethrough; and defining at least one engagement tab extending from the inner surface of the main portion and away from the inner and outer surfaces, wherein the at least one engagement tab is spaced inwardly from the peripheral extension. The overflow cap is configured to be pressed onto a threaded end of the overflow pipe and is configured to engage the threaded end of the overflow pipe via the at least one engagement tab.

In some embodiments, defining the at least one engagement tab comprises defining an outward-facing surface facing the peripheral extension and an inward-facing surface facing away from the peripheral extension. The method may further comprise forming a plurality of teeth in the inward-facing surface that are configured to slidingly engage the threaded end of the overflow pipe. The overflow cap may be configured to be disengaged from the threaded end of the overflow pipe via rotation of the overflow cap with respect to the overflow pipe. In some cases, defining the at least one engagement tab may comprise defining a plurality of engagement tabs.

The method may further comprise forming at least one spacer extending from the inner surface of the main portion and away from the inner and outer surfaces, wherein the spacer is configured to abut an edge of the threaded end of the overflow pipe in the installed position so as to maintain a space between the inner surface of the main portion and the edge of the threaded end of the overflow pipe. Additionally or alternatively, the method may further comprise defining at least one slot in the main portion extending between the inner and outer surfaces, wherein the at least one slot is in fluid communication with the overflow pipe in the installed position

BRIEF DESCRIPTION OF THE DRAWINGS

Figure 1:
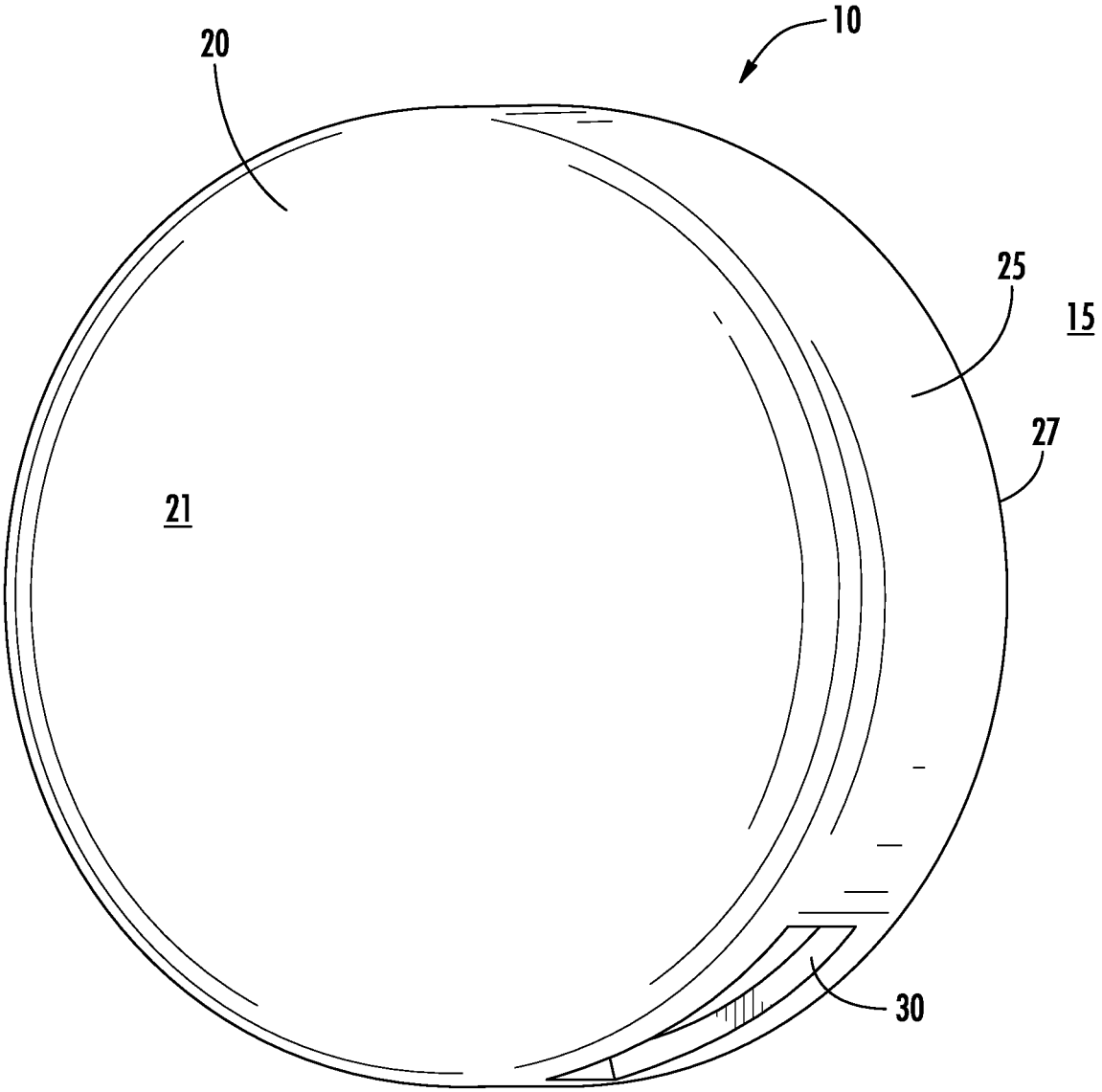
Figure 2:
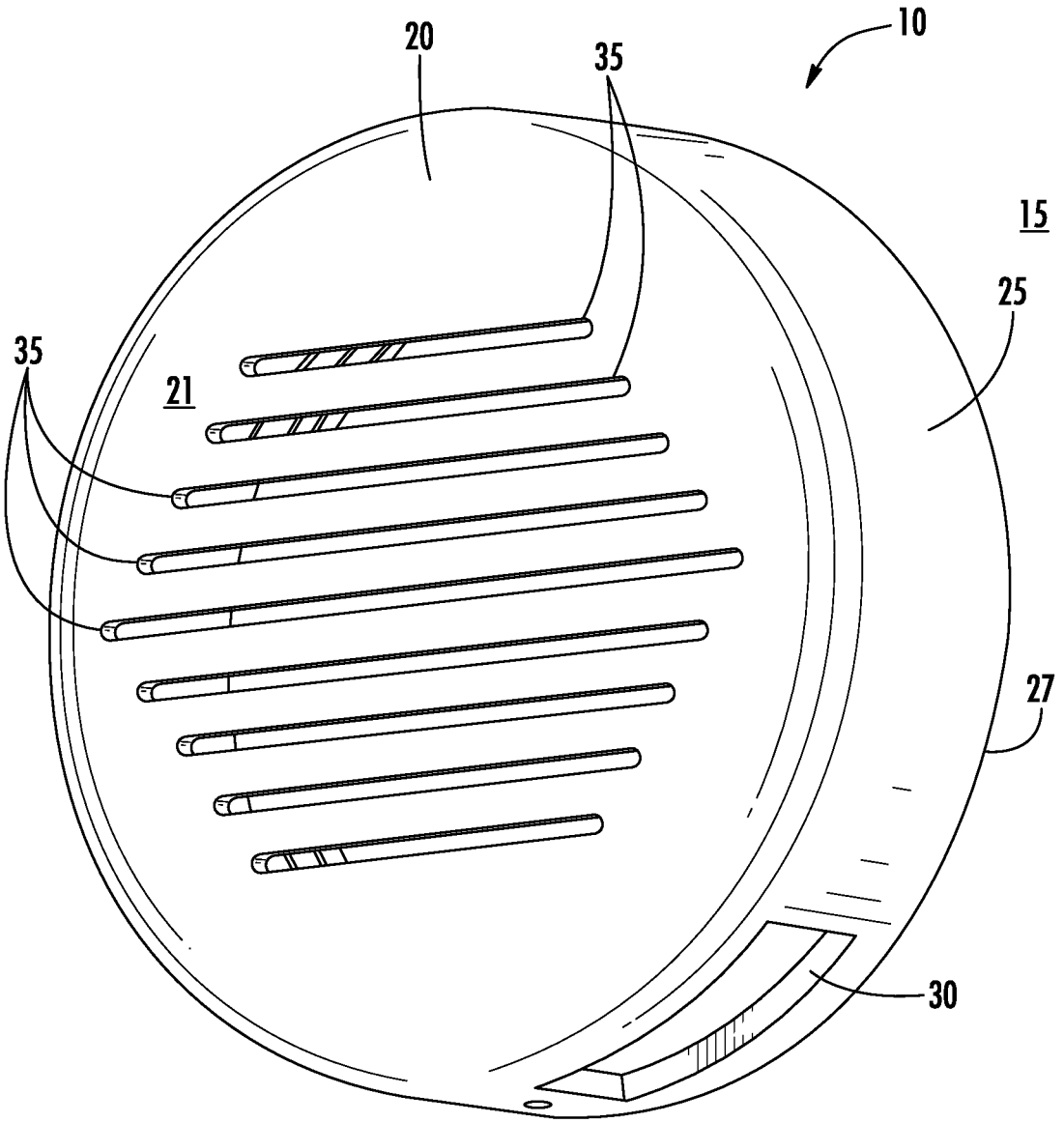
Figure 3:
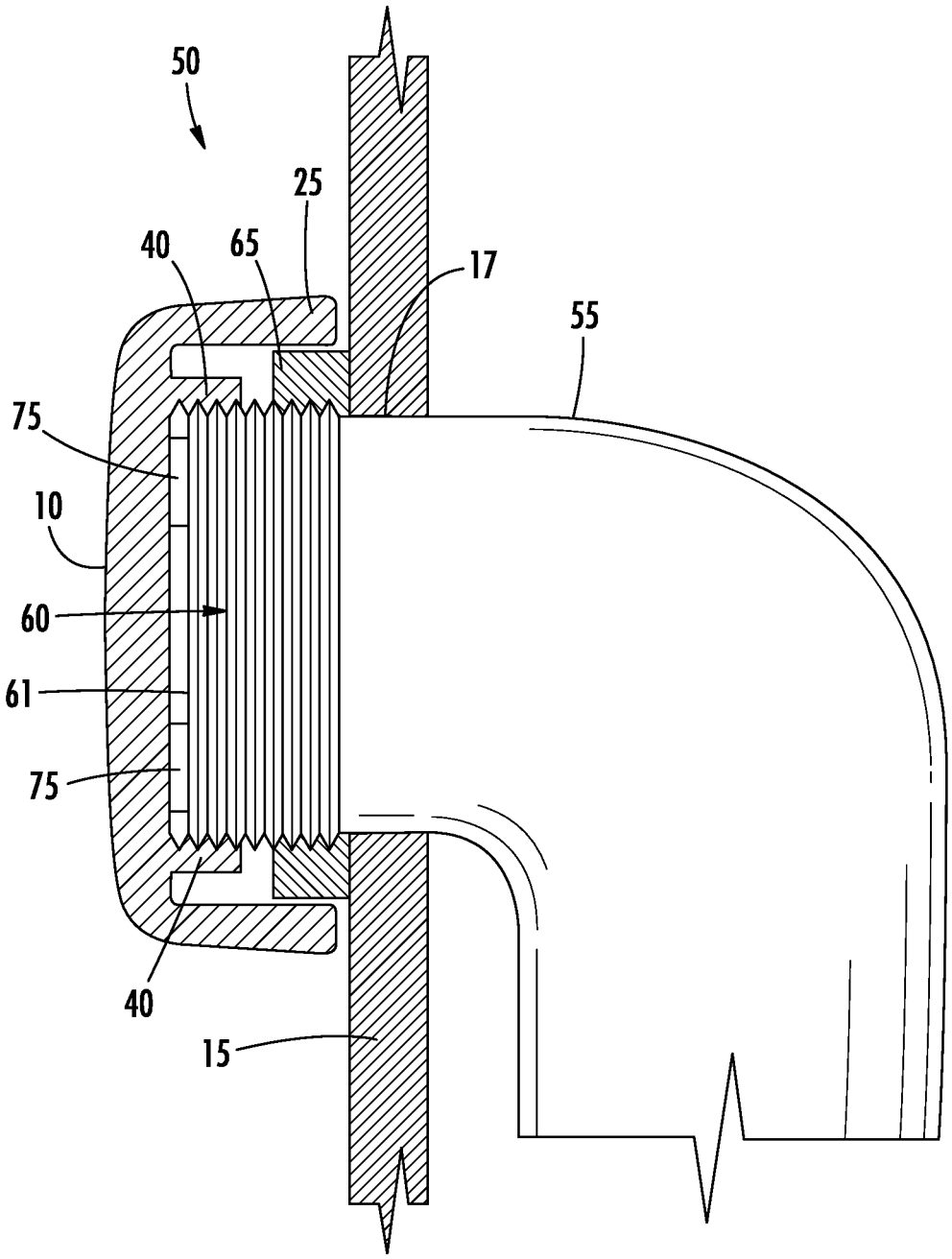
Figure 4:
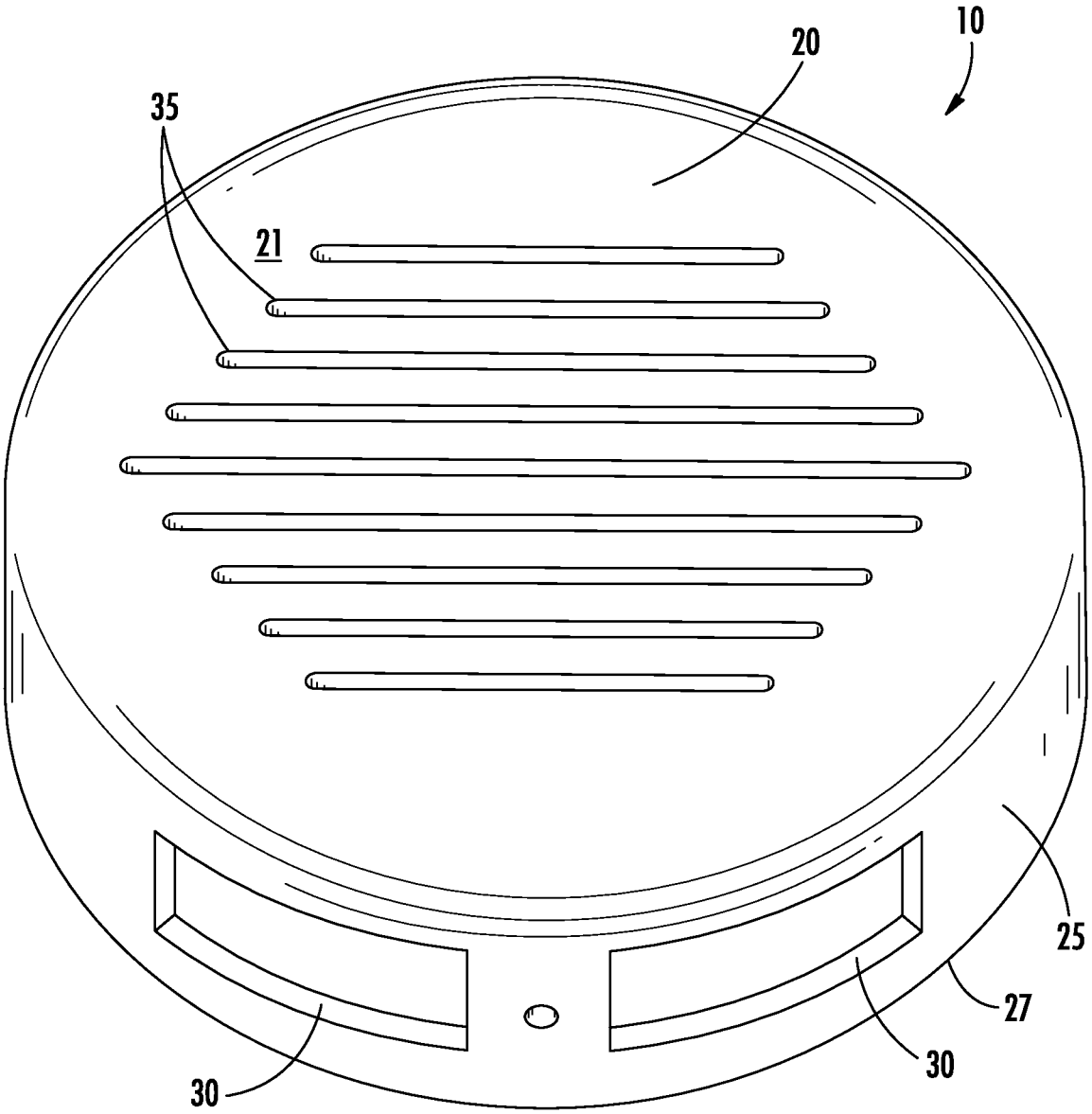
Figure 5:
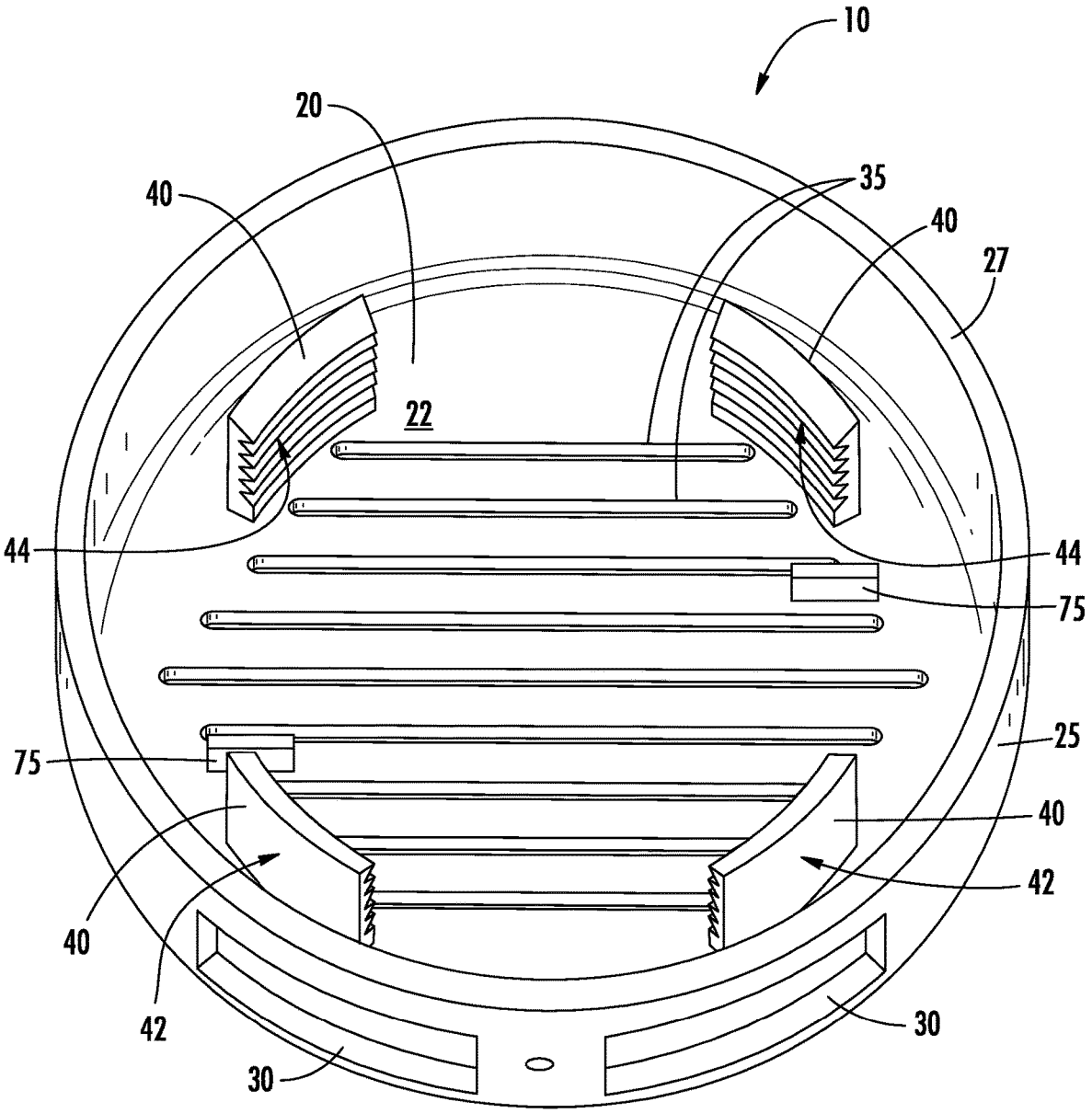
Figure 6:
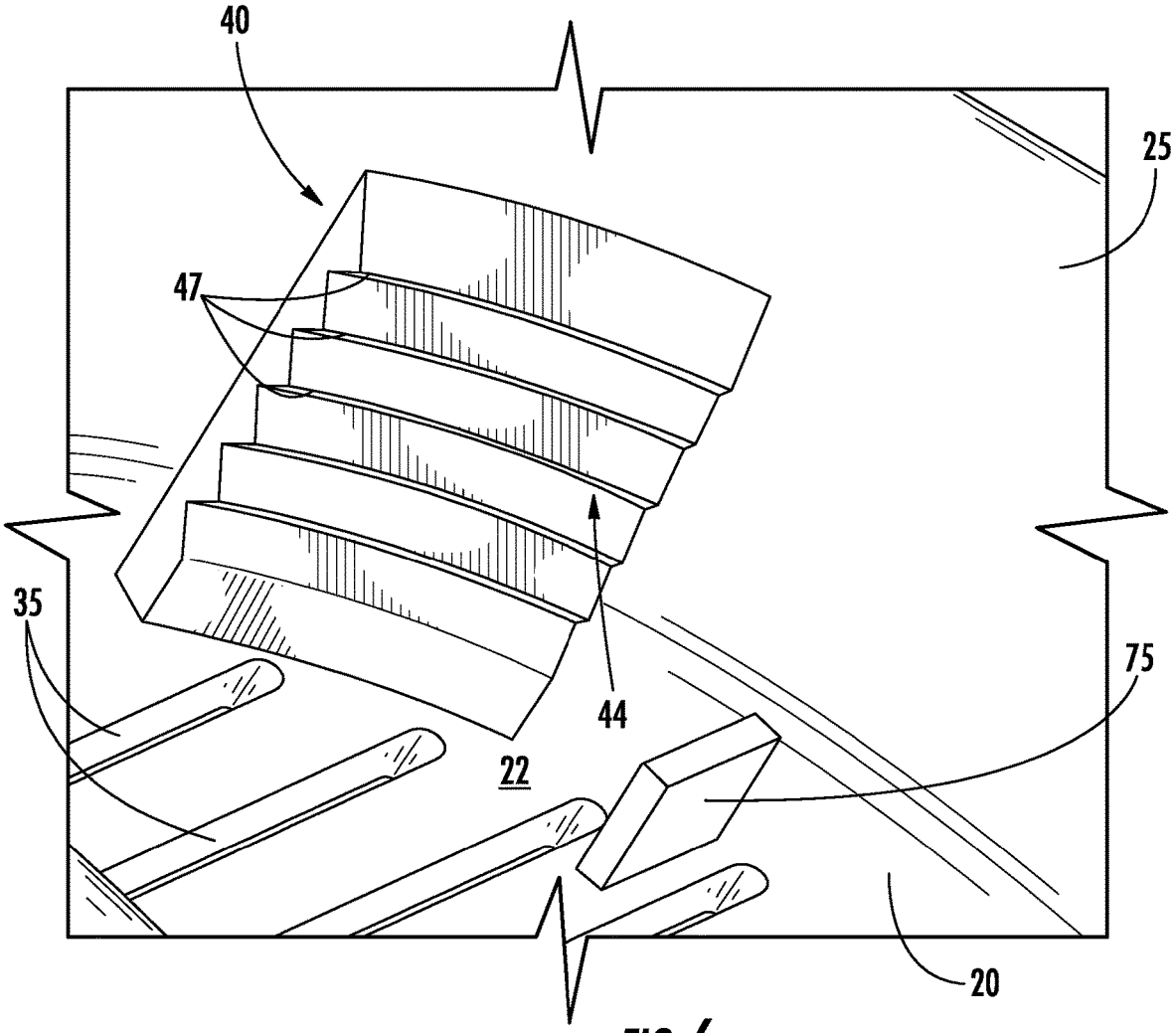
Figure 7:
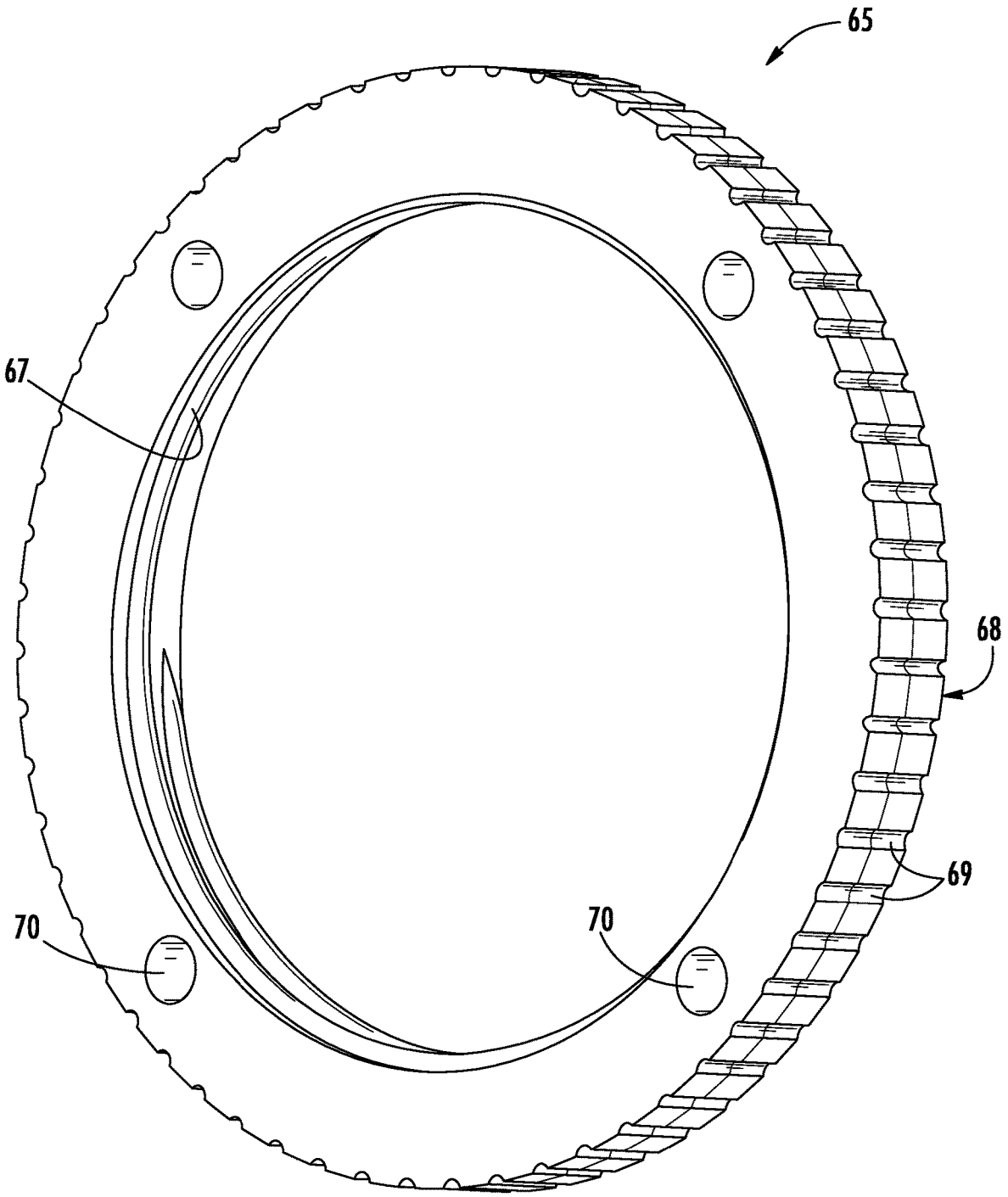

Having thus described the invention in general terms, reference will now be made to the accompanying drawings, which are not necessarily drawn to scale, and wherein:

FIG. 1 is a perspective view of the outer surface of an overflow cap in the installed position according to an embodiment of the present invention;

FIG. 2 is a perspective view of the outer surface of an overflow cap in the installed position according to another embodiment of the present invention;

FIG. 3 is a schematic cross-sectional view of an overflow assembly with an overflow cap and a locking ring installed on an overflow pipe according to an embodiment of the present invention;

FIG. 4 is a perspective bottom view of the outer surface of an overflow cap according to an embodiment of the present invention;

FIG. 5 is a perspective view of the inner surface of an overflow cap according to an embodiment of the present invention;

FIG. 6 is a close-up view of an engagement tab and spacer of the overflow cap according to an embodiment of the present invention; and FIG. 7 is a perspective view of a locking ring according to an embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Some components of the fixtures, couplings, piping, surroundings, and associated systems are not shown in one or more of the figures for clarity and to facilitate explanation of embodiments of the present invention.

As used herein, the terms "bottom," "top," "upper," "lower," "interior," "exterior," and/or similar terms are used for ease of explanation and refer generally to the position of certain components or portions of the components of embodiments of the described invention in the installed configuration (e.g., in an operational configuration, such as installed in a plumbing fixture). It is understood that such terms are not used in any absolute sense. Moreover, although the examples used below refer primarily to overflow devices and assemblies for use in bathtubs, embodiments of the present invention may further be applicable for preventing overflow of various other plumbing fixtures (e.g., sinks, basins, etc.) and in other contexts.

Plumbing fixtures, such as bathtubs, that are configured to receive and/or hold an amount of liquid (e.g., water) often include a primary drain and an overflow drain. Using the example of bathtubs, the primary drain may be, for example, an opening in the bottom or lowest point of the bathtub that is in fluid communication with a drainpipe, through which the water is designed to flow out of the bathtub. The primary drain may be designed to be plugged or stopped in some cases, such as by applying a cover onto the drain or actuating a toggle or lever proximate the drain that closes the drain and precludes or at least substantially limits the flow of water through the primary drain. The primary drain may be plugged in this manner intentionally by the user, such as when the user wishes to fill the bathtub up with water. In some cases, however, the primary drain and/or drainpipe may become plugged unintentionally over time, such as due to an accumulation of debris in the drain or drainpipe.

In either case, to prevent overflow of the water in the bathtub or other plumbing fixture, an overflow pipe may be installed that is in fluid communication with the drainpipe and with bathtub, such that if the water level in the bathtub reaches a certain point, the water will no longer accumulate in the bathtub, but rather will be communicated out of the bathtub via the overflow pipe.

Rather than provide an uncovered hole in the wall of the bathtub or other plumbing fixture through which the water may pass once it reaches a certain level for avoiding further accumulation of the water, through applied effort and ingenuity the inventors have designed an aesthetically appealing and effective overflow cap and assembly that is configured to fit over and engage an overflow pipe installed in the wall of a bathtub or other plumbing fixture, as described in greater detail below with reference to the figures.

Turning now to FIG. 1, for example, an overflow cap 10 is shown that is installed on an overflow pipe 55 (shown in FIG. 3) through a wall 15 of the bathtub or other plumbing fixture. In this regard, the overflow cap 10 includes a main portion 20 that is configured to cover the hole in the wall 15, such as for aesthetic reasons, once the overflow cap is installed, as shown. The overflow cap 10 may further include a peripheral extension 25 that extends transversely (e.g., in a perpendicular or nearly perpendicular direction with respect to the main portion) from a periphery (e.g., an outer edge) of the main portion 20. The peripheral extension 25 may be configured to extend towards the wall 15 through which the overflow pipe is engaged, such that an edge 27 of the peripheral extension 25 may come into abutting contact with, nearly abutting contact with, or spaced from the wall 15.

As shown in FIG. 1, the main portion 10 may be configured to have a smooth, sleek look, with a solid main portion structure, such that no water can pass through the main portion. Rather, the peripheral extension 25 may be configured such that it defines at least one opening 30 that is configured to be in fluid communication with the overflow pipe for receiving overflow water therethrough. For example, in the depicted embodiment as more clearly shown in FIG. 4, which provides a perspective bottom view of the overflow cap 10, two openings 30 are defined in the peripheral extension 25. In other embodiments, however, additional openings 30 may be defined in the peripheral extension 25, such as three openings or four openings or more, and the openings may have various shapes (e.g., rectangular, square, oval, circular, etc.) and sizes. Moreover, although the openings 30 are shown as being provided in a bottom part of the peripheral extension 25, in other cases the openings 30 may be on the sides, at the top, or at multiple locations around the peripheral extension, depending on the application and/or the user's preferences.

Although in the embodiment depicted in FIG. 1 the main portion 20 is solid and does not allow water to pass through, in other embodiments, such as the embodiments depicted in FIGS. 2 and 4-6, the main portion may define one or more slots 35. For example, the main portion 20 may define an outer surface 21 (shown in FIGS. 1 and 4) and an inner surface 22 (shown in FIG. 5). The outer surface 21 may be configured to be visible to a user in an installed position (e.g., as shown in FIGS. 1-2), in which the overflow cap 10 is engaged with an overflow pipe, and the inner surface 22 may be configured to be disposed proximate the overflow pipe in the installed position. In some embodiments, at least one slot 35 may extend between the inner 22 and outer 21 surfaces of the main portion 20, and, as such, the at least one slot 35 may be in fluid communication with the overflow pipe in the installed position. Therefore, embodiments of the overflow cap 10 that include one or more slots 35 in the main portion 20 may, for example, be used in "high-flow" applications, in which a higher flow of water through the overflow cap 10 is anticipated in an overflow scenario.

Regardless of the particular configuration of the main portion 20 (e.g., unslotted as shown in FIG. 1 or slotted as shown in FIGS. 2 and 4-6), the overflow cap 10 may further include at least one engagement tab 40 extending from the inner surface 22 of the main portion 20 and away from the inner 22 and outer 21 surfaces, as shown in FIG. 5. In this regard, the at least one engagement tab 40 may be spaced inwardly from the peripheral extension 25, such that the at least one engagement tab 40 is positioned to allow the overflow cap 10 to engage an externally threaded end of the overflow pipe via the at least one engagement tab, such as through the user pressing the overflow cap 10 onto the externally threaded end of the overflow pipe.

With reference to FIG. 3, for example, which depicts a partial cross-sectional view of an overflow assembly 50 with the overflow cap 10 in the installed position, the overflow pipe 55 may be inserted through a hole 17 in the wall 15 during installation of the assembly, such that the externally threaded end 60 of the overflow pipe extends through the wall 15 and is able to be received by and engage the overflow assembly 50. The overflow assembly 50 may thus include a locking ring 65 (also shown in FIG. 7) that has a threaded inner surface 67 and is configured to be threaded onto the externally threaded end 60 of the overflow pipe 55. Threading of the locking ring 65 onto the threaded end 60 of the overflow pipe 55 is thus configured to secure the overflow pipe 55 with respect to the wall 15, such that the overflow cap 10 may be pressed onto the threaded end 60 of the overflow pipe following engagement of the locking ring 65 with the overflow pipe, and the overflow cap 10 may be engaged with the overflow pipe via engagement of the engagement tabs 40 with the threaded end. For example, as illustrated in FIG. 7, in some cases the locking ring 65 may comprise an outer surface 68 that defines a plurality of grooves 69 configured to provide a gripping surface to the user for installing the locking ring onto the overflow pipe. Moreover, in some embodiments, the locking ring 65 may further define one or more transverse holes 70 that are configured to receive one or more features of a tool that may be used to facilitate attachment or removal of the locking ring 65.

In some embodiments, the at least one engagement tab 40 may comprise a plurality of engagement tabs. For example, in the depicted embodiment, the overflow cap 10 includes four discrete engagement tabs 40 spaced around an inner circumference of the main portion 20 of the overflow cap. The distance between opposite engagement tabs 40 (e.g., a diameter of the inner circumference formed by the engagement tabs) may be sized to correspond to the diameter of the externally threaded end 60. For example, the distance between opposite engagement tabs 40 may be sized about the same or slightly smaller than the outer diameter of the externally threaded end 60 of the overflow pipe 55, and the material and design of the engagement tabs 40 may be such that the engagement tabs are configured to flex outwardly (e.g., towards the peripheral extension 25) to allow engagement of the teeth 47 with the external threads of the overflow pipe when the overflow cap 10 is pushed onto the end, while not allowing the teeth to disengage from the threads when the user attempts to pull the overflow cap off the end of the overflow pipe.

For example, as shown in FIGS. 5 and 6, the at least one engagement tab 40 of the overflow cap 10 may define an outward-facing surface 42 facing the peripheral extension 25 (best seen in FIG. 5 with regard to the two engagement tabs 40 at the bottom of the figure) and an inward-facing surface 44 facing away from the peripheral extension (shown in FIG. 5 with regard to the two engagement tabs 40 at the top of the figure and in the larger view of FIG. 6). The inward-facing surface 44 may define a plurality of teeth 47 (FIG. 6) that are configured to slidingly engage the externally threaded end 60 of the overflow pipe 55, such as when the user pushes the overflow cap 10 into engagement with the end of the overflow pipe, after the locking ring 65 is threaded in place, as shown in FIG. 3.

In some embodiments, however, the overflow cap 10 is configured (e.g., due to the configuration of the teeth 47) such that the overflow cap can be disengaged from the externally threaded end 60 of the overflow pipe 55 when the user rotates the overflow cap with respect to the overflow pipe. In other words, the teeth 47 may, in some cases, be configured (e.g., sized and shaped) such that although the overflow cap 10 can be pressed on or pushed into engagement with the threaded end 60 of the overflow pipe 55, the overflow cap can only be removed from the overflow pipe by twisting the cap off to unthread it.

With reference to FIGS. 5 and 6, in some embodiments the overflow cap 10 may comprise at least one spacer 75 extending from the inner surface 22 of the main portion 20 and away from the inner and outer surfaces 21, 22. The spacer 75 may be configured to abut an edge 61 of the externally threaded end 60 of the overflow pipe 55 in the installed position (FIG. 3) so as to maintain a space between the inner surface 22 of the main portion 20 and the edge 61 of the externally threaded end of the overflow pipe 55. In this way, the spacer(s) 75 may prevent the inner surface 22 of the overflow cap 10 from being pressed tightly against the edge 61 of the overflow pipe 55, which could result in restricted water flow.

Accordingly, with reference to FIG. 3 and as described above, which shows the overflow assembly in the installed position, embodiments of the present invention provide an overflow assembly 50 that is configured to engage an overflow pipe 55 and includes an overflow cap 10 and a locking ring 65. The locking ring 65 may comprise a threaded inner surface 67 (FIG. 7) that is configured to be threaded onto an externally threaded end 60 of the overflow pipe 55. A user may thus initially thread the locking ring 65 onto the threaded end 60 of the overflow pipe 55 to secure the overflow pipe with respect to the wall 15.

Once the locking ring 65 is in place, the overflow cap 10 may be pressed onto the externally threaded end 60 of the overflow pipe 55, such that the overflow cap 10 engages the externally threaded end 60 of the overflow pipe 55 via the engagement tabs 40 described above and shown in FIGS. 5 and 6. In some embodiments, the overflow cap 10 is configured such that, in the installed position shown in FIG. 3, the peripheral extension 25 of the overflow cap surrounds the locking ring 65, but is spaced from the outer diameter of the locking ring 65, such that the peripheral extension of the overflow cap does not come into contact with the locking ring. For example, the inner diameter of the peripheral extension 25 of the overflow cap 10 may be sized larger than the outer diameter of the locking ring 65. In some cases, for example, the clearance between the peripheral extension 25 of the overflow cap 10 and the locking ring 65 in the installed position shown in FIG. 3 may be approximately 0.070 inches.

In some embodiments, a method of manufacturing an overflow cap is provided. The method may include forming a main portion defining an outer surface and an inner surface, wherein the outer surface is configured to be visible to a user in an installed position in which the overflow cap is engaged with an overflow pipe, and wherein the inner surface is configured to be disposed proximate the overflow pipe in the installed position. The method may further include providing a peripheral extension extending transversely from a periphery of the main portion and configured to extend towards a wall through which the overflow pipe is engaged. As described above with reference to the figures, the peripheral extension may define at least one opening configured to be in fluid communication with the overflow pipe for receiving overflow water therethrough. The method may further include defining at least one engagement tab extending from the inner surface of the main portion and away from the inner and outer surfaces. The at least one engagement tab may be spaced inwardly from the peripheral extension. Thus, as described above, the overflow cap may be configured to be pressed onto a threaded end of the overflow pipe and may be configured to engage the threaded end of the overflow pipe via the at least one engagement tab.

In some cases, defining the at least one engagement tab may comprise defining an outward-facing surface facing the peripheral extension and an inward-facing surface facing away from the peripheral extension. In this regard, the method may further comprise forming a plurality of teeth in the inward-facing surface that are configured to slidingly engage the threaded end of the overflow pipe, as described above. Moreover, in some embodiments, the overflow cap may be configured to be disengaged from the threaded end of the overflow pipe via rotation of the overflow cap with respect to the overflow pipe. Defining the at least one engagement tab may comprise defining a plurality of engagement tabs, such as two, three, or four engagement tabs, or more than four engagement tabs in some cases.

In some embodiments, the method may comprise forming at least one spacer extending from the inner surface of the main portion and away from the inner and outer surfaces. The spacer may be configured to abut an edge of the threaded end of the overflow pipe in the installed position so as to maintain a space between the inner surface of the main portion and the edge of the threaded end of the overflow pipe, as described above. In still other embodiments, such as for making an overflow cap for use in high-flow applications, the method may further comprise defining at least one slot in the main portion of the overflow cap extending between the inner and outer surfaces. The at least one slot may thus be in fluid communication with the overflow pipe in the installed position to allow more water to flow into the overflow pipe.

The overflow cap 10 and its components and/or the locking ring 65 may be made in various ways using different manufacturing processes, as appropriate. In some cases, for example, the overflow cap 10 may molded out of various materials, including rigid Acrylonitrile Butadiene Styrene (ABS), PVC, or other materials.

As noted above, the structures and components depicted in the figures have been simplified for clarity and ease of explanation. For example, features may be included in some embodiments of the overflow assembly and its surroundings that are not described above and/or not shown in the figures for ease of explanation, but which may facilitate manufacture, installation, sale, or practicability of use. In addition, many other modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Moreover, steps in the methods described above may occur in any order and are not limited to the order described above.

What is claimed is:

1. An overflow assembly configured to engage an overflow pipe, the overflow assembly comprising:

an overflow cap including:

a main portion defining an outer surface and an inner surface, wherein the outer surface is configured to be visible to a user in an installed position in which the overflow cap is engaged with an overflow pipe;

a peripheral extension extending transversely from a periphery of the main portion and configured to extend towards a wall through which the overflow pipe is engaged, wherein the peripheral extension defines at least one opening configured to be in fluid communication with the overflow pipe for receiving overflow liquid therethrough; and a plurality of discrete engagement tabs, each engagement tab extending from the inner surface of the main portion and away from the inner and outer surfaces, wherein each engagement tab is spaced inwardly from the peripheral extension and is substantially parallel to an inner surface thereof; and a locking ring comprising a threaded inner surface configured to be threaded onto an externally threaded end of the overflow pipe, wherein the locking ring is configured to secure the overflow pipe with respect to the wall, wherein the overflow cap is configured to be pressed onto the externally threaded end of the overflow pipe following engagement of the locking ring with the overflow pipe, wherein the overflow cap is configured to engage the externally threaded end of the overflow pipe via the plurality of engagement tabs, wherein the inner diameter of the peripheral extension is larger than the outer diameter of the locking ring, and wherein the peripheral extension of the overflow cap does not contact the locking ring.

2. The overflow assembly of claim 1, wherein the peripheral extension defines at least two openings configured to be in fluid communication with the overflow pipe for receiving overflow liquid therethrough.

3. The overflow assembly of claim 1, wherein the overflow cap further comprises at least one spacer extending from the inner surface of the main portion and away from the inner and outer surfaces, wherein the spacer is configured to abut an edge of the externally threaded end of the overflow pipe in the installed position so as to maintain a space between the inner surface of the main portion and the edge of the externally threaded end of the overflow pipe.

4. The overflow assembly of claim 1, wherein the main portion further defines at least one slot extending between the inner and outer surfaces of the main portion, wherein the at least one slot is in fluid communication with the overflow pipe.

5. The overflow assembly of claim 1, wherein the locking ring comprises an outer surface defining a plurality of grooves configured to provide a gripping surface to the user for installing the locking ring onto the overflow pipe.

6. The overflow assembly of claim 1, wherein each engagement tab of the overflow cap defines an outward-facing surface facing the peripheral extension and an inward-facing surface facing away from the peripheral extension, wherein the inward-facing surface defines a plurality of teeth configured to slidingly engage the externally threaded end of the overflow pipe.

7. The overflow assembly of claim 6, wherein the overflow cap is configured to be disengaged from the externally threaded end of the overflow pipe via rotation of the overflow cap with respect to the overflow pipe.

8. An overflow cap configured to engage an overflow pipe that includes a locking ring attached thereto, the overflow cap comprising:

a main portion defining an outer surface and an inner surface, wherein the outer surface is configured to be visible to a user in an installed position in which the overflow cap is engaged with an overflow pipe;

a peripheral extension extending transversely from a periphery of the main portion and configured to extend towards a wall through which the overflow pipe is engaged, wherein the peripheral extension defines at least one opening configured to be in fluid communication with the overflow pipe for receiving overflow liquid therethrough; and a plurality of discrete engagement tabs, each engagement tab extending from the inner surface of the main portion and away from the inner and outer surfaces, wherein each engagement tab is spaced inwardly from the peripheral extension and is substantially parallel to an inner surface thereof, wherein the overflow cap is configured to be pressed onto an externally threaded end of the overflow pipe and is configured to engage the threaded end of the overflow pipe via the plurality of engagement tabs, wherein the inner diameter of the peripheral extension is larger than the outer diameter of the locking ring, and wherein the peripheral extension does not contact the locking ring.

9. The overflow cap of claim 8, wherein the peripheral extension defines at least two openings configured to be in fluid communication with the overflow pipe for receiving overflow liquid therethrough.

10. The overflow cap of claim 8 further comprising at least one spacer extending from the inner surface of the main portion and away from the inner and outer surfaces, wherein the spacer is configured to abut an edge of the threaded end of the overflow pipe in the installed position so as to maintain a space between the inner surface of the main portion and the edge of the threaded end of the overflow pipe.

11. The overflow cap of claim 8, wherein the main portion further defines at least one slot extending between the inner and outer surfaces of the main portion in fluid communication with the overflow pipe.

12. The overflow cap of claim 8, wherein each engagement tab defines an outward-facing surface facing the peripheral extension and an inward-facing surface facing away from the peripheral extension, wherein the inward-facing surface defines a plurality of teeth configured to slidingly engage the threaded end of the overflow pipe.

13. The overflow cap of claim 12, wherein the overflow cap is configured to be disengaged from the threaded end of the overflow pipe via rotation of the overflow cap with respect to the overflow pipe.

* * * * *